US006375023B1

(12) United States Patent
Lecinski et al.

(10) Patent No.: US 6,375,023 B1
(45) Date of Patent: Apr. 23, 2002

(54) PRESS-ON/PRY-OFF COMPOSITE CLOSURE WITH REMOVAL-ASSIST AND METHOD OF MAKING SAME

(75) Inventors: Frank H. Lecinski, Naperville; Carsten Pfromm, Willowbrook, both of IL (US)

(73) Assignee: White Cap, Inc., Downers Grove, IL (US)

( * ) Notice: Subject to any disclaimer, the term of this patent is extended or adjusted under 35 U.S.C. 154(b) by 0 days.

(21) Appl. No.: 09/539,046

(22) Filed: Mar. 30, 2000

(51) Int. Cl.[7] ..... B65D 41/46; B21D 51/44

(52) U.S. Cl. ..... 215/253; 215/274; 215/304; 215/305; 413/8

(58) Field of Search ..... 215/274, 304, 215/305, 302, 250, 253; 220/284, 285, 266; 413/2, 6, 8, 9; 53/487

(56) References Cited

U.S. PATENT DOCUMENTS 3,746,199 A * 7/1973 Hart et al. ..... 215/274
3,820,678 A * 6/1974 Zipper et al. ..... 215/274
3,913,771 A * 10/1975 Acton et al. ..... 215/274
4,244,479 A * 1/1981 Smalley ..... 215/253
4,347,940 A * 9/1982 Boik et al. ..... 215/304
4,423,822 A * 1/1984 Powalowski ..... 215/305
4,576,298 A * 3/1986 Boik ..... 215/274
4,721,219 A * 1/1988 Dullabaun et al. ..... 215/274
4,921,113 A * 5/1990 Dubach ..... 215/305
5,341,949 A * 8/1994 Hayes ..... 215/274

* cited by examiner

*Primary Examiner*—Nathan J. Newhouse
(74) *Attorney, Agent, or Firm*—Cook, Alex, McFarron, Manzo, Cummings & Mehler Ltd.

(57) ABSTRACT

A press-on/pry-off closure includes a separately formed circular end panel, preferably composed of metal, and a surrounding rim composed of a flexible plastic, preferably a thermoplastic polyolefin. The end panel is top-side inserted into the rim and secured between a radially inwardly extending ledge on an interior sidewall of a skirt portion of the rim and a plurality of radially inwardly extending panel-retaining formations adjacent an upper edge of the rim. The skirt includes a removal-assist portion which, in the illustrated embodiment, is in the form a hinged tab integrally formed with the rim. The tab is outwardly pivotable about the hinge axis for applying a lifting force to the rim to facilitate removal of the closure from a container.

21 Claims, 3 Drawing Sheets

PRESS-ON/PRY-OFF COMPOSITE CLOSURE WITH REMOVAL-ASSIST AND METHOD OF MAKING SAME

BACKGROUND OF THE INVENTION

This invention generally relates to press-on/pry-off closures and, more particularly, to composite press-on/pry-off closures having a removal assist feature as well as to methods of making the same. In this regard, an important aspect of the present invention is directed to an improved press-off/pry-off composite closure which is especially suited for use with containers having a beaded finish which closure is formed by top-side insertion of a metal end panel into an injection molded rim composed of a flexible plastic such as a thermoplastic polyolefin wherein the rim includes a thumb engageable removal-assist tab.

When press-on/pry-off closures are removed from containers, particularly those which have been closed under vacuum, a larger than normal force is required to break the vacuum to move the closure. This force, in addition to the interlock between the closure skirt and the container neck finish, is dependent upon closure size and vacuum level. Accordingly, it is desirable to provide effective removal-assist features for such closures, particularly where they are applied to packaged products which have a high degree of fluidity and are thus susceptible to spillage.

Press-on/pry-off composite closures having removal-assist features are well known in the prior art and have been commonly used for a wide variety of products including hot fill and cool products as well as for closed retorted products. For example, U.S. Pat. No. 4,423,822 which issued to Continental White Cap, Inc. describes a press-on/pry-off closure that is provided with a thumb engageable tab formed within the skirt that aids in the removal of the closure from a container to which it is applied. That closure, while highly satisfactory for commercial use by packers and consumers, includes a construction which requires that the end panel be inserted into the bottom-side of a preformed flexible plastic rim and, as such, is characterized by component manufacturing and assembly steps which are relatively complex and costly. For example, the plastic rims of such closure have a sidewall design which require relatively large undercuts for facilitating removal from the injection mold. Correspondingly, the forces necessary to insert the end panel past the lugs make assembly more relatively difficult and require the use of heavier and/or more rigid end panels.

The present invention is an improvement over the aforementioned press-on/pry-off composite closures and provides a novel press-on/pry-off composite closure formed of a top-side inserted metal end panel and flexible plastic rim having a thumb engageable removal-assist tab. This rim includes an annular skirt having an interior surface that is provided with a ledge for receiving and supporting the end panel, a plurality of container bead-engageable lugs below that ledge and a plurality of panel-retaining flexible formations adjacent an upper edge of the rim. The lugs extend radially inwardly a distance greater than the radial-inward extent of both the ledge and the panel-retaining flexible formations. Insertion of the end panel into the top side of the rim is enabled by the sizing and construction of the panel-retaining formations which are axially spaced from the ledge to define an end panel-engaging segment in the rim which is sized to snugly receive and secure the end panel.

The thumb-engageable tab is integrally formed with the rim and positioned below the upper edge of the rim. A hinge portion at the upper end of the tab enables it to be outwardly pivoted to thereby apply a lifting force to the rim when the closure is on a container. If desired, the side portions of the tab can be joined to the remainder of the skirt portion by relatively thin membranes which either permanently deform or fracture when the tab is actuated.

It is, therefore, a general object of the present invention to provide a new and improved composite press-on/pry-off closure having a top-side inserted end panel which is captured within a surrounding plastic rim having a skirt portion that includes a thumb-engageable pivotable tab for applying a lifting force to the rim to facilitate removal of the closure from a container to which is it applied.

Another object of the present invention is to provide an improved press-on/pry-off composite closure having a top side inserted metal end panel surrounded by a plastic skirt having a construction which permits the use of a metal end panel having an outer periphery which is curled to provide a concealed raw cut-edge.

Another object of the present invention is to provide a novel and improved method of forming a press-on/pry-off composite closure.

Another object of the present invention is to provide an improved press-on/pry-off composite closure having a metal end panel and seal area characterized by improved plastic sidewall rim protection of the end panel, enabling the closure to withstand greater impact abuse.

Another object of the present invention is to provide an improved press-on/pry-off composite metal closure having a metal end panel surrounded by a plastic rim having a sidewall skirt which tapers inwardly from the top portion of the skirt to the bottom portion thereof, thereby minimizing if not totally eliminating the possibility of the sidewall skirt coming into contact with shipping container dividers and the like and avoiding inadvertent and/or unintentional removal of the closure from a container to which it is applied.

Another object of the present invention is to provide an improved press-on/pry-off composite closure having a thumb engageable removal assist tab which provides visual evidence of tampering.

These and other objections of the present invention will be apparent from the following detailed description taken in conjunction with the accompanying drawings wherein like reference numerals refer to like parts and in which.

DESCRIPTION OF A PREFERRED EMBODIMENT

Figure 1:
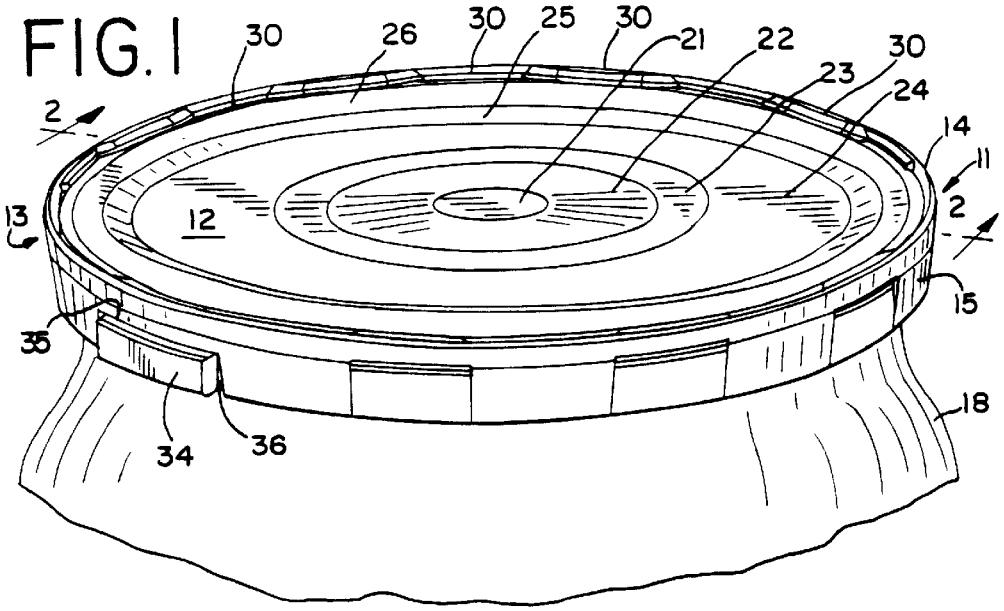
FIG. 1 is a top perspective view of a press-on/pry-off composite closure formed in accordance with the present invention and applied to a glass container.
Figure 2:
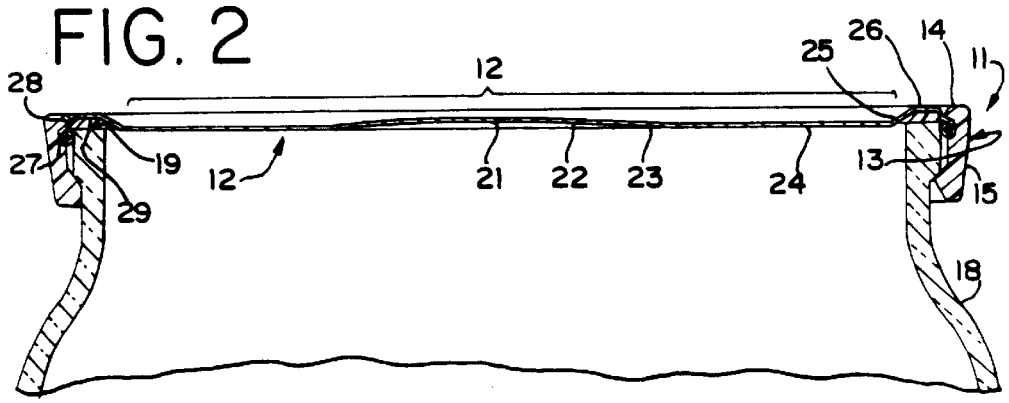
FIG. 2 is a sectional view taken along the line 2—2 of the closure cap and container shown in FIG. 1.
Figure 3:
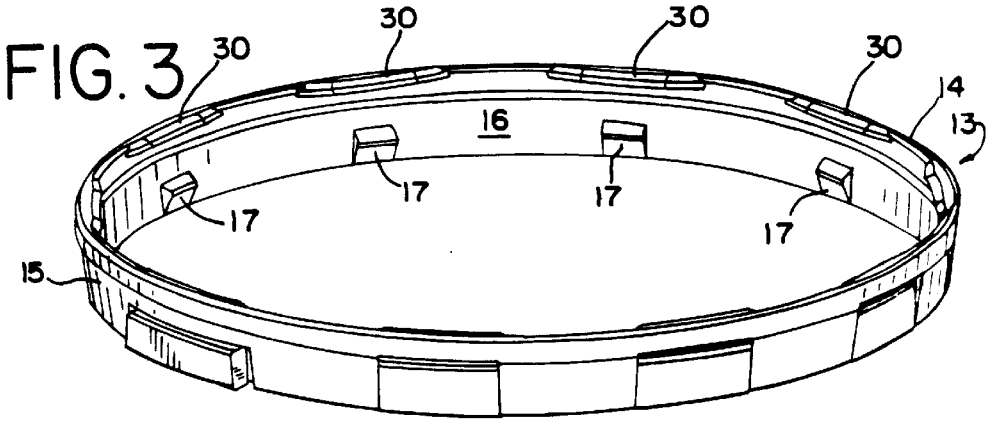
FIG. 3 is a perspective view of the rim portion of the composite closure shown in FIG. 1.
Figure 4:
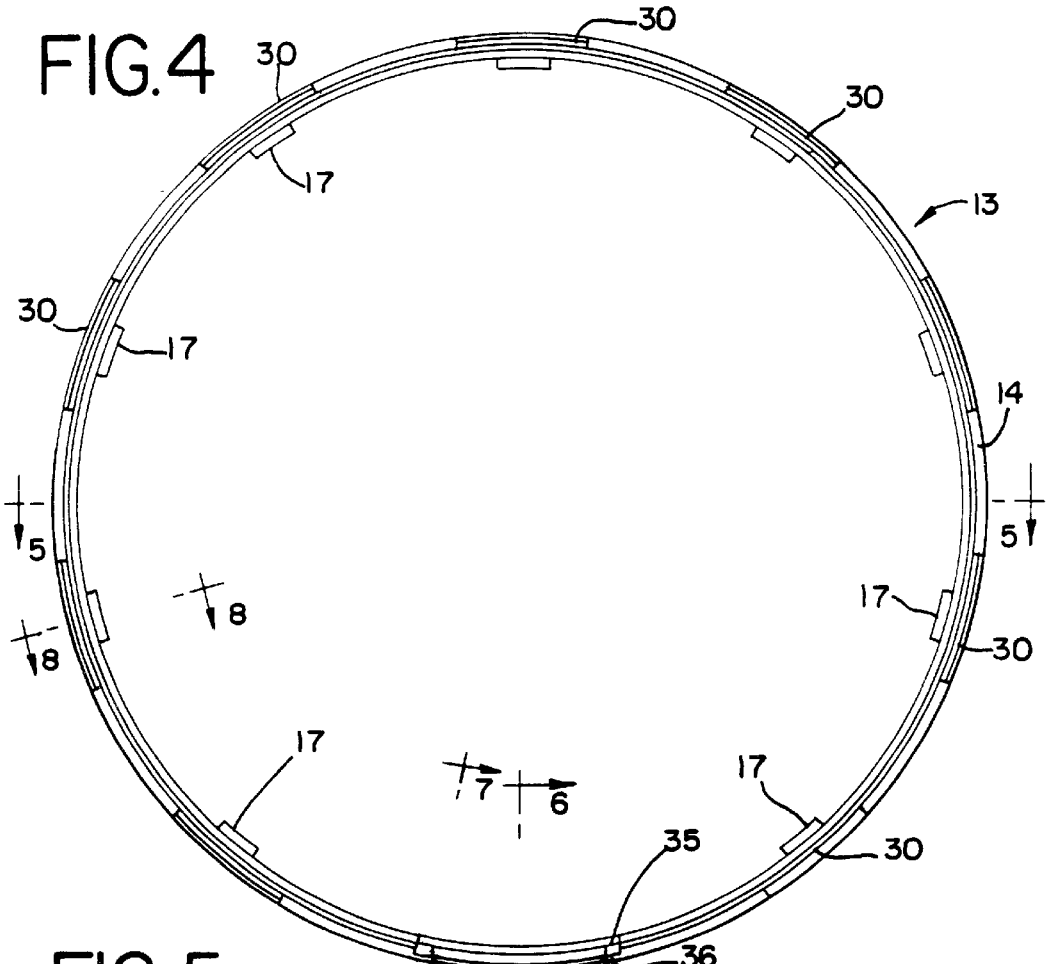
FIG. 4 is a top plan view of the rim portion of the closure shown in FIG. 3.
Figure 5:
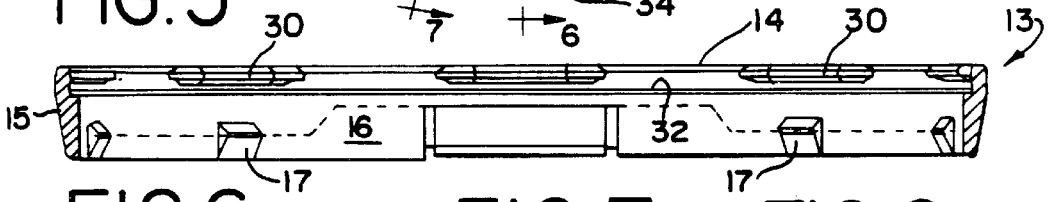
FIG. 5 is a sectional view taken along the line 5—5 of FIG. 4.
Figure 7:
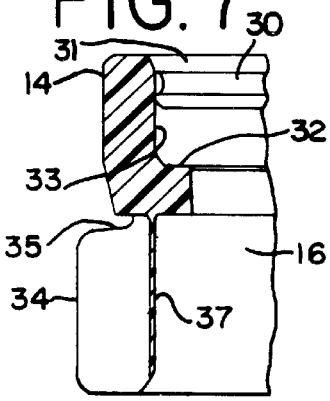
FIG. 7 is a fragmentary sectional view taken along the line 7—7 of FIG. 4.
Figure 8:
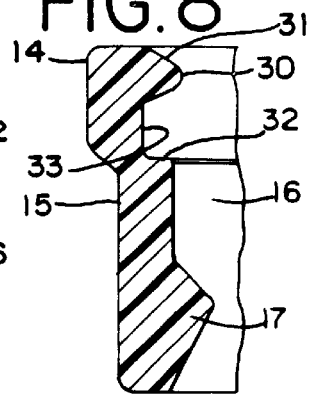
FIG. 8 is a fragmentary sectional view taken along the line 8—8 of FIG. 4.
Figure 9:
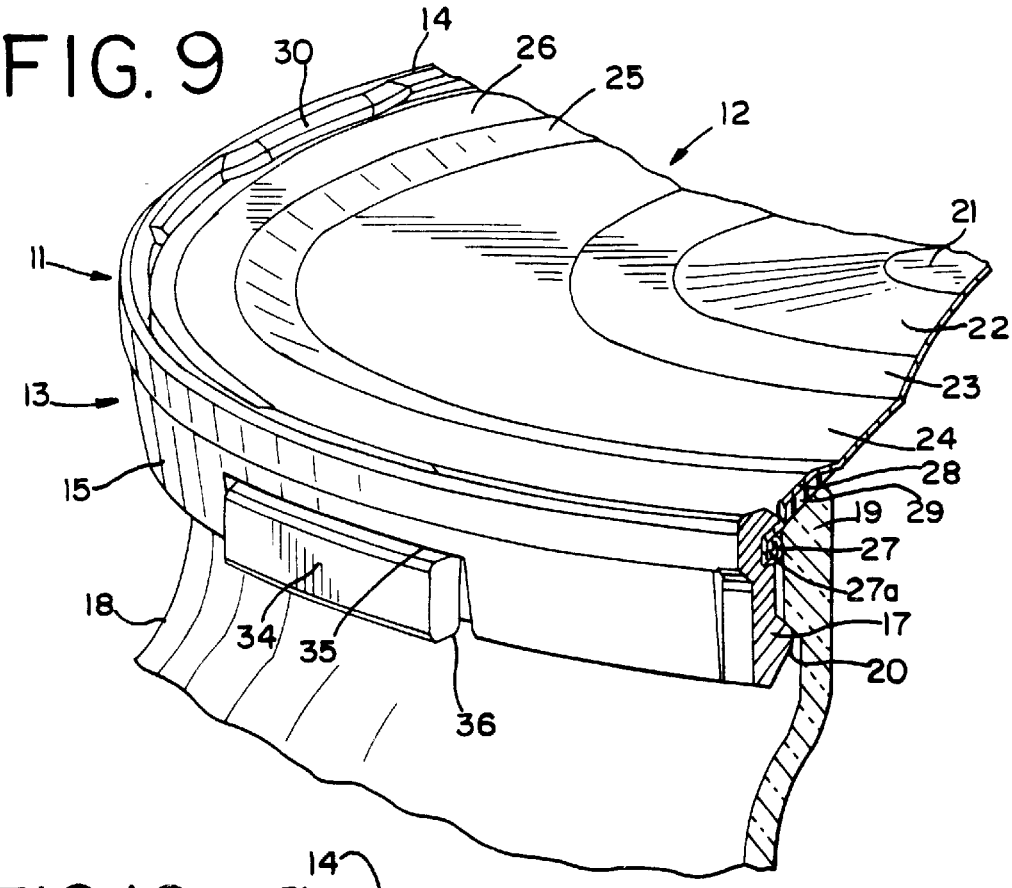
FIG. 9 is a fragmentary perspective view showing the composite closure of the present invention in a sealed position on a container; and, FIG. 10 is a fragmentary perspective view like that shown in FIG. 9 wherein the tab has been activated and the closure partially removed.

Referring to the drawings and with particular reference to FIGS. 1–10, a composite press-on/pry-off closure cap embodying the present invention is generally designated by the reference numeral 11 and includes an end panel 12 which is captured within a rim 13 composed of a flexible thermoplastic polyolefin such as, for example, polypropylene. As shown, rim 13 has an upper edge 14 which extends into a downwardly depending skirt 15 having an interior surface 16 from which a plurality of lugs 17 radially inwardly extend. As best shown in FIGS. 2 and 9, the composite closure 11 is seated on a glass container 18 which includes a finish 19 having a locking bead 20 that engages the lugs 17 to secure the closure 11 to the container 18. While, in the illustrated embodiment, the lugs have a generally rectangular cross-section, it will be appreciated that other geometric configurations which provide effective securement of the closure cap 11 to the locking bead 20 of container 18 can be employed.

End panel 12 is preferably composed of metal, however, other materials exhibiting suitable oxygen barrier properties can also be used. In the illustrated embodiment, end panel 12 includes an upwardly projecting button 21 that sequentially extends radially outwardly into a downwardly and outwardly inclined first flange 22 surrounded by a second flange 23, a generally flat annular area 24, an upwardly and outwardly inclined flange 25, and a generally flat annular rim portion 26 which terminates at its outer periphery in a curled end portion 27. While, in the illustrated embodiment the end portion is provided with an inside curl it will be appreciated that an outside curl could alternatively be provided, both of which are suitable for concealing the raw, unrepaired cut-edge 27*a* of the end panel 12 which results from the metal blanking operation. As is known in the art, the creation of a vacuum condition in the container to which the closure is applied will result in the downward axial movement and depression of the button 21 while release of the vacuum will cause the button to return to its as-formed position.

Outer flange 25, flat rim 26 and the downwardly extending portion of the end panel 12 adjacent curled portion 27 cooperate to define an annular channel 28 on the underside of the end panel in which a suitable gasket 29 is provided. The gasket 29 can be composed of a variety of resilient materials such as, for example, a spin-lined PVC plastisol.

In accordance with an important aspect of the present invention, upper edge 14 of rim 13 is provided with a plurality of inwardly extending panel-retaining flexible formations 30 which are best illustrated in FIGS. 3–8. As shown, each of formations 30 includes an inwardly and downwardly slanted surface 31 that cooperates with a radially inwardly extending ledge 32 which to define a plurality of panel engaging segments 33 which are sized to snugly receive and secure the end panel therebetween.

Figure 6:
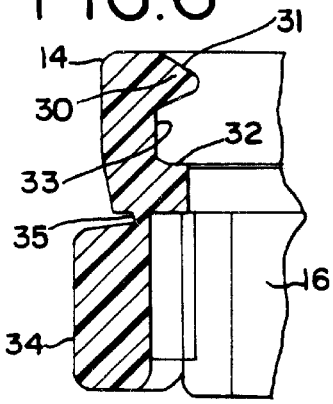
FIG. 6 is a fragmentary sectional view taken along the line 6—6 of FIG. 4.

As best shown in FIGS. 6–8, the lugs 17 project radially inwardly into the interior of rim 13 and skirt 15 to an extent greater than either the innermost extent of ledge 32 or projections 30. Accordingly, the rim 13 is designed to permit top side insertion of the end panel 12, providing for easy closure assembly and eliminating the need to force the end panel 13 past the lugs 17. Additionally, the top side insertion feature of this invention enables a sidewall design that facilitates easy removal of the rim 13 from the injection mold at the time of its manufacture.

In accordance with the present invention, downwardly depending skirt 15 includes a removal-assist portion that can be used to facilitate removal of the closure cap 11 from the container 18. In the illustrated embodiment, a preferred removal-assist portion is in the form of a thumb-engageable tab 34 integrally formed with the skirt 15 which includes a hinge portion 35 at its upper edge and about which the tab pivots when the closure cap is removed from a container to which it is applied (see FIG. 10). If desired, relatively thin membranes 36 or bridges (not shown) can be integrally formed between the opposed lateral sides of tab 34 and the adjacent portions of skirt 15 so that, upon activation of the tab will either permanently deform or fracture to show that the closure has been removed from the container, thereby serving as a tamper-evident indicator. Other forms of removal-assist portions include an inverted cup-shaped protrusion (with or without a hinge connection) as well as generally laterally extending ears that can be easily grasped by the consumer during closure removal.

A suitable procedure for manufacturing the composite closure 11 involves initially forming the end panel 12 in a metal stamping press followed by the formation of the curl portion 27. The pressed shell with the curl formed therein is then spin-lined with a PVC plastisol gasket material deposited in channel 28 and is then passed through a plastisol curing oven to cure the gasket 29. Rim 13 is preferably formed by an injection molding process and the metal panel then pressed into the top side of the rim to create the finished closure assembly.

Figure 10:
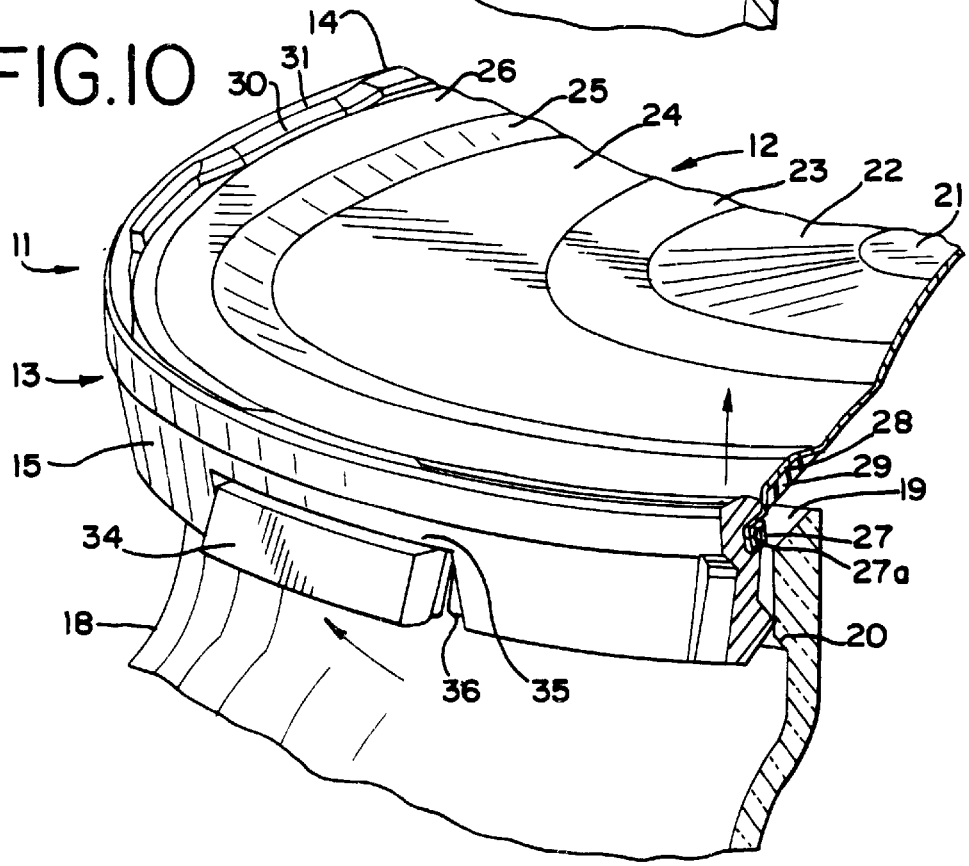

In operation the closure is applied to a container by a suitable capping machine to form the finished assembly. As shown in FIG. 10, the closure is removed from the container 18 by outwardly pivoting the tab 34 resulting in an upward lifting force on the closure which facilitates passage of the lug 17 over and around locking bead 20 permitting the container, if vacuum packed, to vent thereby facilitating removal of the closure from the container. It will, of course, be appreciated that while tab 34 has been referred to as a thumb-engageable tab, a suitable kitchen utensil or other tool can be used to provide additional leverage on the tab during the pivoting thereof.

The present invention has been described in the context of a preferred embodiment and with respect to various modifications thereto as set forth therein. It will be apparent, however, to those skilled in this art that modifications and variations may be made without departing from the spirit and scope of this invention. Accordingly, this invention is to be construed and limited only by the scope of the appended claims.

We claim:

1. A press-on/pry-off composite closure comprising:

an end panel having an upper surface;

an annular rim composed of a flexible plastic surrounding said end panel, said rim having an upper edge located above the upper surface of said end panel and an integral skirt having an annular sidewall extending downwardly therefrom from and terminating in a free edge, wherein said annular sidewall of said skirt has an outer surface that is angled inwardly from said upper edge to said free edge, said annular sidewall of said skirt having an interior surface which includes an integral radially extending ledge for receiving and supporting said end panel, an inwardly integral projecting locking means on said interior sidewall of said skirt positioned below said ledge and engageable with an outside surface on a container to which said closure is applied for securing said closure to an open end of said container, said locking member extending radially inwardly a distance greater than the radial-inward extent of said ledge, a plurality of inwardly extending panel-retaining flexible formations adjacent to said upper edge of said rim and integrally formed therewith, said formations being deflectable to permit insertion of said end panel into said rim from said upper surface thereof and being axially spaced above said ledge to define an end-panel engagement segment in said rim which is sized to snugly receive and secure said end panel in said rim; and, a removal-assist portion integrally formed with said rim and positioned below said upper edge on said skirt, said removal-assist portion being positioned along a portion of said skirt and including a surface that can be grasped to apply a lifting force to said rim to facilitate removal of said closure from said container.

2. The composite closure of claim 1 wherein said radially extending ledge for receiving and supporting said end panel and said locking means comprises a plurality of integral lugs on said interior sidewall of said skirt positioned below said ledge and engageable with an outside surface on a container to which said closure is applied for securing said closure to an open end of said container, said locking member extending radially inwardly a distance greater than the radial-inward extent of said ledge.

3. The composite closure of claim 1 wherein said end panel is composed of metal.

4. The composite closure of claim 1 wherein said end panel has a raw cut-edge which is contained within a curled formation of said panel.

5. The composite closure of claim 1 wherein said ledge is continuous.

6. The composite closure of claim 1 wherein said end panel has a bottom surface which includes an annular plastisol gasket.

7. The composite closure of claim 1 wherein said end panel includes an axially moveable button which is depressed when a vacuum condition is present in a container to which said closure is applied and which is upwardly extended to its as-formed condition in the absence of a vacuum condition in said container.

8. The composite closure of claim 1 wherein said rim is composed of a thermoplastic polyolefin.

9. The composite closure of claim 8 wherein said polyolefin is polypropylene.

10. The composite closure of claim 1 wherein said removal-assist portion is a thumb-engageable tab integrally formed with said rim and positioned below said upper edge on said skirt, said tab having an upper end joined to said skirt by an integral hinge and being outwardly pivotable about said hinge for applying a lifting force to said rim to facilitate removal of said closure from said container.

11. The composite closure of claim 10 wherein said tab includes at least one lateral side integrally connected to the sidewall of said skirt by a relatively thin membrane that will stretch and permanently deform or rupture when said tab is actuated to provide a visual indication of tampering.

12. The composite closure of claim 10 wherein said tab includes at least one lateral side integrally connected to the sidewall of said skirt by at least one relatively thin bridge that will fracture when said tab is actuated to provide a visual indication of tampering.

13. A press-on/pry-off composite closure for use with a container having a neck finish that includes an outwardly directed locking bead, said closure comprising:

a generally circular metal end panel having an upper surface and an outer cut edge contained within a curled formation of said end panel;

an annular rim composed of a flexible polyolefin surrounding said end panel, said rim having an upper edge located above the upper surface of said end panel and an integral skirt having an annular sidewall extending downwardly therefrom and terminating in a free edge, wherein said annular sidewall of said skirt has an outer surface that is angled inwardly from said upper edge to said free edge, an outer surface on said sidewall, said outer surface being angled inwardly from said upper edge to said free edge, said annular sidewall of said skirt having an interior surface which includes an integral radially extending continuous ledge for receiving and supporting said end panel, a plurality of integral lugs on said interior sidewall positioned below said ledge, said lugs extending radially inwardly to a distance greater than the radial-inward extent of said continuous ledge for engaging a bottom surface of a locking bead on a container to which said closure is applied, a plurality of inwardly directed panel-retaining formations adjacent to said upper edge of said rim and integrally formed therewith, said formations having downwardly slanted upper surface and being deflectable to permit top-side insertion of said metal end panel into said rim and being axially spaced above said ledge to define an end panel engagement segment in said rim sized to snugly receive and secure said end panel in said rim; and, a generally rectangular tab integrally formed with said rim and positioned below the upper edge of said skirt, said tab having an upper end joined to said skirt by an integral hinge and being outwardly pivotable about said hinge for applying a lifting force to said rim to facilitate removal of said closure from said container.

14. The composite closure of claim 13 wherein said rim is composed of polypropylene.

15. The composite closure of claim 13 wherein said generally rectangular tab includes at least one side that is integrally connected to the sidewall of said skirt by a relatively thin membrane that will stretch and permanently deform or fracture when said tab is actuated to provide a visual indication of tampering.

16. The composite closure of claim 13 wherein said generally rectangular tab includes at least one side that is integrally connected to the sidewall of said skirt by at least one relatively thin bridge that will rupture to provide a visual indication of tampering.

17. The composite closure of claim 13 wherein said end panel has a bottom surface which includes an annular plastisol gasket.

18. The composite closure of claim 13 wherein said end panel includes an axially movable button that is depressed when a vacuum condition is present in a container to which said closure if applied and axially upwardly extended to its as-formed condition in the absence of a vacuum condition in said container.

19. A method of forming a press-on/pry-off closure which includes an end panel and a rim, said rim having a pivotable thumb engageable tab integrally formed in a sidewall of said rim and a plurality of inwardly extending lugs which are engageable with the bottom surface of a locking bead on a container to which said closure is applied, said method comprising:

providing an annular rim composed of a flexible plastic, said rim having an upper edge and an integral skirt which includes an annular sidewall that extends downwardly therefrom and terminates in a free edge, wherein said annular sidewall of said skirt has an outer surface that is angled inwardly from said upper edge to said free edge, said annular sidewall of said skirt having an interior surface which includes an integral radially extending ledge for receiving and supporting an end panel, an integral securement member on said interior sidewall positioned below said ledge, said securement member extending radially inwardly a distance greater than the radial-inward extent of said ledge, a plurality of inwardly extending panel-retaining formations adjacent to said upper edge of said rim, said formations extending radially inwardly a distance which is less than the radial-inward extent of said lugs, said formations having a downwardly sloped upper surface and being deflectable to permit insertion of an end panel into said rim from said upper edge thereof and being axially spaced above said ledge to define an end panel-receiving segment that will snugly receive and secure said end panel in said rim, a removal-assist portion on said skirt positioned below said upper edge thereof, said removal-assist portion having a surface which can be grasped for applying a lifting force to said closure rim to facilitate removal of said closure from a container to which it is applied;

providing a metal circular end panel having an upper surface and an outer periphery which terminates in a raw cut-edge;

forming a curl in said outer periphery of said end panel to conceal said raw-cut edge;

forming a cured plastisol gasket on the outer periphery of one side of said metal end panel; and, inserting said circular end panel into said rim by passing said end panel from said upper edge into engagement with said formations and ledge of said rim, wherein said upper edge of said rim is located above said upper surface of said end panel.

20. The method of claim 19 wherein said rim is composed of polypropylene.

21. The method of claim 20 wherein said rim is formed by injection molding.

* * * * *